US005873527A

United States Patent [19]

Pattanaik et al.

[11] Patent Number: 5,873,527

[45] Date of Patent: Feb. 23, 1999

[54] FUEL INJECTOR WITH REGULATED PLUNGER MOTION

[75] Inventors: Satish Pattanaik, Ypsilanti, Mich.; Scott F. Shafer, Morton, Ill.

[73] Assignee: Caterpillar Inc., Peoria, Ill.

[21] Appl. No.: 801,985

[22] Filed: Feb. 19, 1997

[51] Int. Cl.[6] ..... F02M 47/02

[52] U.S. Cl. ..... 239/91; 239/92

[58] Field of Search ..... 239/88–92

[56] References Cited

U.S. PATENT DOCUMENTS

| | | | |
|---|---|---|---|
| 2,173,813 | 9/1939 | Bischof | 123/139 |
| 3,481,542 | 12/1969 | Huber | 239/71 |
| 3,737,100 | 6/1973 | Dreisin | 239/89 |
| 4,022,165 | 5/1977 | Eckert et al. | 123/32 |
| 4,407,253 | 10/1983 | Bauer | 123/506 |
| 4,458,648 | 7/1984 | Braun et al. | 123/449 |
| 4,461,259 | 7/1984 | Roca-Nierga | 123/449 |
| 4,475,514 | 10/1984 | List | 239/88 |
| 4,501,244 | 2/1985 | Jarrett et al. | 123/446 |
| 4,718,345 | 1/1988 | Yunan | 102/275.3 |
| 4,745,898 | 5/1988 | Egler et al. | 123/300 |
| 4,840,155 | 6/1989 | Karle | 123/300 |
| 5,007,584 | 4/1991 | Rossignol | 239/88 |
| 5,029,568 | 7/1991 | Perr | 123/447 |
| 5,103,785 | 4/1992 | Henkel | 123/299 |
| 5,287,838 | 2/1994 | Wells | 123/467 |
| 5,323,964 | 6/1994 | Doszpoly et al. | 239/95 |
| 5,423,484 | 6/1995 | Zuo | 239/90 |
| 5,429,309 | 7/1995 | Stockner | 239/533.8 |

FOREIGN PATENT DOCUMENTS

| | | | |
|---|---|---|---|
| 418800 | 3/1991 | European Pat. Off. | 239/88 |
| 58-18552 | 2/1983 | Japan | 239/88 |

*Primary Examiner*—Kevin Weldon
*Attorney, Agent, or Firm*—Michael B. McNeil; Joseph W. Keen

[57] ABSTRACT

A fuel injector includes an injector body with a plunger bore, a nozzle chamber, and a nozzle outlet that opens to the nozzle chamber. A plunger is positioned to reciprocate in the plunger bore between an advanced position and a retracted position. A portion of the plunger and a portion of the plunger bore define a fuel pressurization chamber. At least one of the injector body and the plunger define a main passage extending between the fuel pressurization chamber and the nozzle chamber. At least one of the injector body and the plunger define a restricted passage extending between the fuel pressurization chamber and the nozzle chamber. The restricted passage restricts flow of fuel to the nozzle chamber over the beginning portion of each injection event. The main passage is substantially closed over a portion of the plunger's movement between its retracted position and its advanced position.

20 Claims, 5 Drawing Sheets

FUEL INJECTOR WITH REGULATED PLUNGER MOTION

TECHNICAL FIELD

This invention relates generally to fuel injectors, and more particularly to hydraulically actuated fuel injectors with rate shaping produced by regulating plunger motion.

BACKGROUND ART

Engineers have recognized that reductions in NOx emissions and combustion noise can be achieved during some engine operating conditions by slowing the initial rate of injection into the combustion chamber. Thus, it is desirable that a fuel injector have the ability to extend the time duration over which the injection goes from zero to its maximum. Although it is settled that combustion noise and NOx emissions can be reduced by slowing the initial injection rate build up, there remains considerable debate as to what initial injection rate profile achieves the best reductions in noise and emissions.

In the case of hydraulically actuated fuel injectors, initial rate shaping has been successfully introduced by spilling fuel to a return line instead of out of the nozzle during the initial portion of each injection event. The initial injection rate is reduced by allowing a significant amount of controlled fuel spillage through a plunger groove and/or holes in a barrel port. This spillage concept has been an effective front end rate shaping method, providing a significant amount of combustion noise reduction (~9 dB) and achieving significant overall engine noise reduction (~3 dB).

The present invention is directed as an alternative to the fuel spillage concept as it relates to producing initial injection rate shaping to reduce NOx emissions and combustion noise.

DISCLOSURE OF THE INVENTION

During the initial injection period, when limited fuel delivery is desired, the motion of the plunger is slowed by forcing the fuel pumped by the plunger to pass through a restriction. The resulting pressure drop through the restriction slows the initial plunger motion and the associated discharge rate from the nozzle to the combustion chamber. This provides a desirable slow initial rate of injection comparable to that of the fuel spillage concept. After the plunger has stroked through an initial distance, known as a lead distance, a main flow path connects the fuel pressurization chamber to the nozzle supply passage, and avoids the initial flow restriction. The main injection is then delivered at full pressure and rate.

In one specific embodiment, a fuel injector includes an injector body with a plunger bore, a nozzle chamber and a nozzle outlet that opens to the nozzle chamber. A plunger is positioned to reciprocate in the plunger bore between an advanced position and a retracted position. A portion of the plunger and a portion of the plunger bore define a fuel pressurization chamber. At least one of the injector body and the plunger define at least one passage extending between the fuel pressurization chamber and the nozzle chamber. The at least one passage has a restrictive flow area over a portion of the plunger's movement between its retracted position and its advanced position. The at least one passage also has a main or relatively unrestricted passage over a different portion of the plunger's movement between its retracted position and its advanced position.

One object of the present invention is to provide an improved hydraulically actuated fuel injector.

BEST MODE FOR CARRYING OUT THE INVENTION

Figure 1:
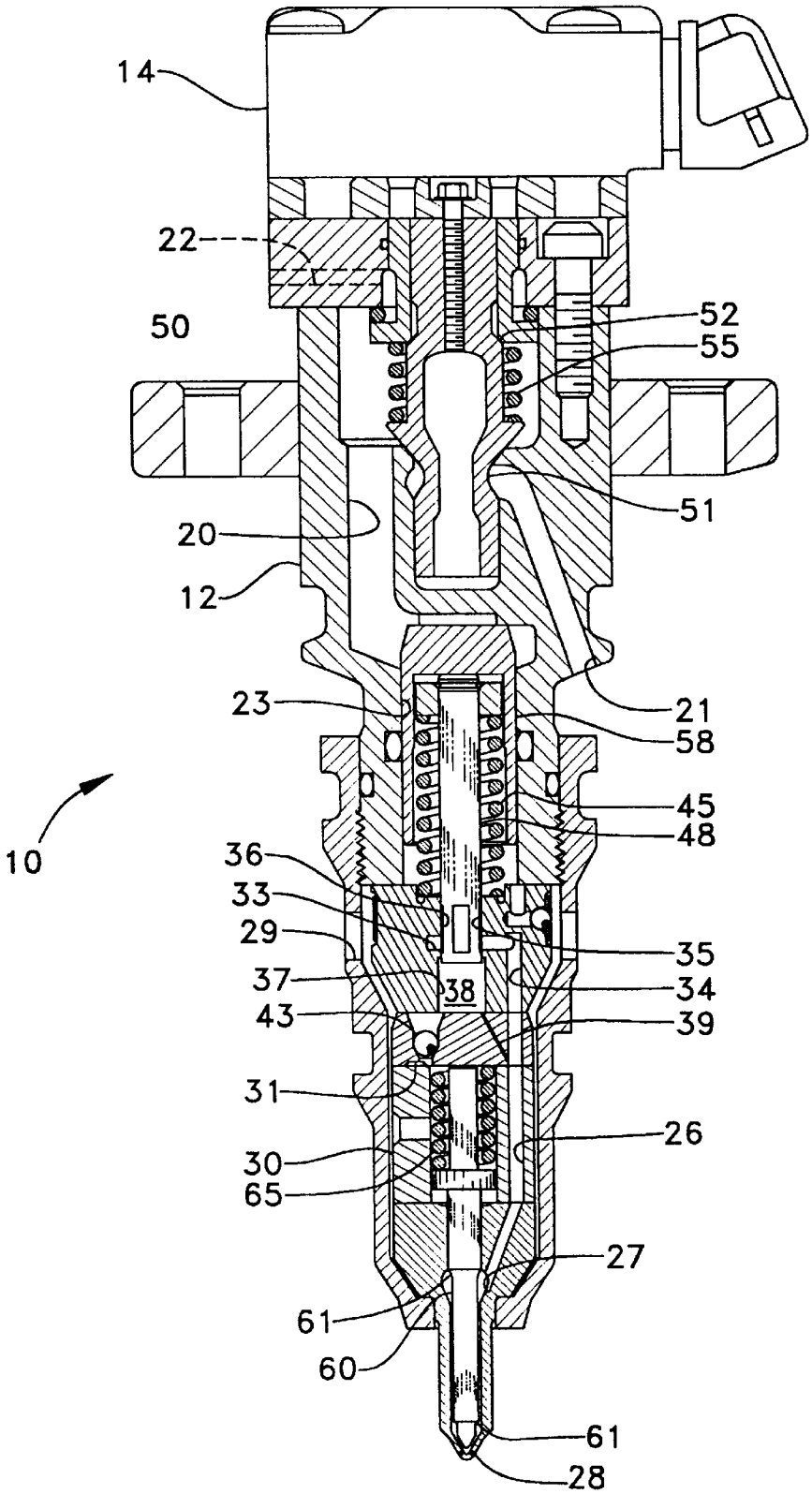
FIG. 1 is a sectioned side elevational view of a fuel injector according to one embodiment of the present invention.

Referring now to FIG. 1, the hydraulically actuated electronically controlled fuel injector 10 according to the present invention is shown as a modified fuel injector of the type manufactured by Caterpillar, Inc., of Peoria, Ill. The various components and operation of fuel injector 10 is described in numerous prior art patents owned by Caterpillar, Inc. Nevertheless, it may be useful to briefly review the major components and functioning of injector 10 before introducing the regulated plunger motion rate shaping concepts of the present invention.

Fuel injector 10 includes an injector body 12 that defines an actuation fluid cavity 20 that opens to a high pressure actuation fluid inlet 21, a low pressure actuation fluid drain 22 and a piston bore 23. The injector body 12 also includes a piston bore 23, a nozzle supply passage 26, a nozzle chamber 27 and a nozzle outlet 28. Plunger bore 35 is connected to nozzle supply passage 26 via a restrictive passageway 39, and via a separate and different main flow passage 34. Injector body also includes a fuel supply inlet 29 and fuel supply passages 30 and 31.

An intensifier piston 58 is positioned to reciprocate in piston bore 23 between an advanced position and a return position (as shown). A plunger 48 moves with piston 58 within plunger bore 35 between an advanced position and a retracted position (as shown). A portion of plunger bore 35 and a portion of plunger 48 define a fuel pressurization chamber 38. During each injection event, fuel is pressurized within fuel pressurization chamber 38 due to the downward motion of plunger 48 and intensifier piston 58. This downward force is produced by hydraulic pressure acting on the top of intensifier piston 58 due to the flow of high pressure actuation fluid, preferably lubricating oil, from high pressure inlet 21 into cavity 20.

Fuel supplied to each injector 10 enters at a fuel inlet 29 that connects with fuel pressurization chamber 38 via supply passages 30 and 31. A ball check valve 43 prevents the back flow of fuel from fuel pressurization chamber 38 to fuel inlet 29 when the plunger is moving in its downward stroke during an injection event.

Each injection event begins when solenoid 14 is energized to move actuation control valve member 50 off its high pressure seat 51 to allow high pressure actuation fluid to flow into actuation fluid cavity 20 from inlet 21. at the same time, control valve member 50 moves to close its drain seat 52 to close actuation fluid cavity 20 to low pressure drain 22. Pressure quickly builds within actuation fluid cavity 20 causing the intensifier piston 58 and plunger 48 to begin their downward stroke. When the fuel pressure within nozzle chamber 27 reaches a valve opening pressure via connection to fuel pressurization chamber 38, the hydraulic forces acting on lift surface(s) 61 of needle valve 60 are sufficient to overcome return spring 65.

Each injection event is ended by de-energizing solenoid 14 to allow control valve member 50 to return to close its high pressure seat 51 under the action of return spring 55. This also re-opens drain seat 52 to allow actuation fluid to drain from cavity 20 as piston 58 and plunger 48 retract under the action of return spring 45. Fuel flows past ball valve 43 to replenish the supply within fuel pressurization chamber 38 during the piston/plunger return stroke. Thus, each injection cycle includes an injection mode, a re-fueling mode, and a standby mode. The present invention is primarily concerned only with the beginning portion of each injection mode.

Figure 2:
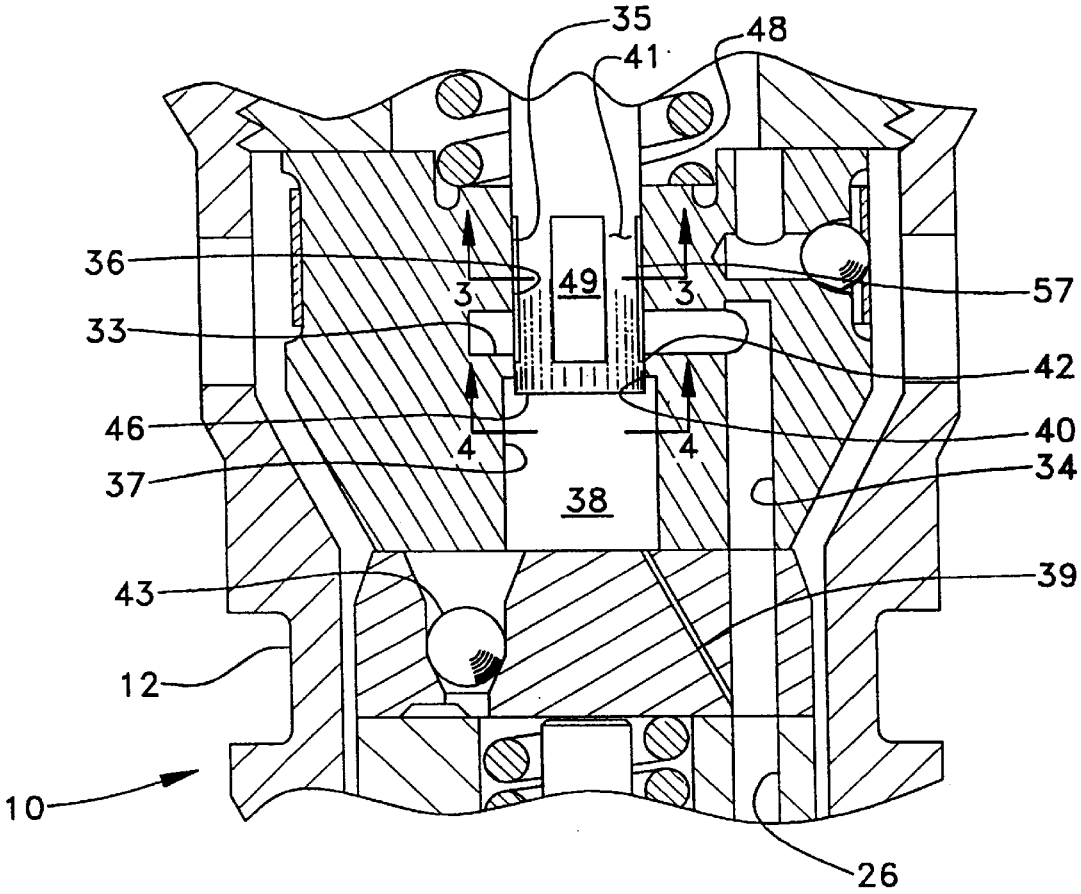
FIG. 2 is an enlarged partial sectioned side elevational view of the fuel pressurization chamber area of the inject or shown in FIG. 1.
Figure 3:
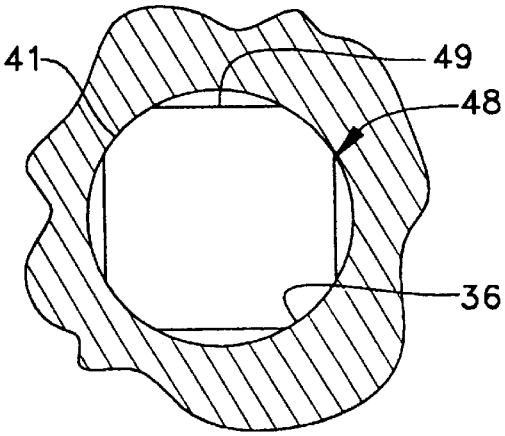
FIG. 3 is a partial sectioned bottom view along section lines 3—3 of FIG. 2.
Figure 4:
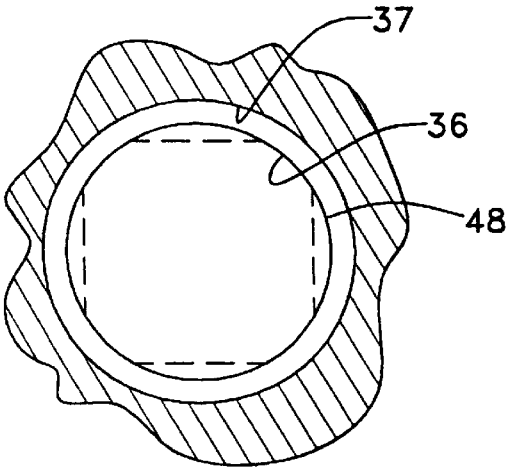
FIG. 4 is a partial sectioned bottom view along section lines 4—4 of FIG. 2.

Referring now to FIGS. 2–4, an enlarged view of the fuel pressurization chamber 38 area of injector 10 is shown in order to better illustrate the present invention. In this view, plunger 48 is shown in its fully retracted position just before the initiation of an injection event. Unlike the substantially cylindrical plungers of the prior art, plunger 48 of the present invention includes a cylindrical portion 41 that is machined to include four flats 49. The circular areas between flats 49 act as guides in the movement of the plunger by maintaining contact with the wall of plunger bore 35. This creates a volume 57 between the outer surface of plunger 48 and the upper portion 36 of plunger bore 35. Volume 57 is in turn in fluid communication with nozzle supply passage 34 via an annulus 33 machined in plunger bore 35. Volume 57 is isolated from fuel pressurization chamber 38 since end 46 of plunger 48 is machined to a tight clearance with the upper bore portion 36 of plunger bore 35. Thus, until edge 42 of plunger 48 clears annular shoulder 40 of plunger bore 35 when the plunger 48 is moving in its downward stroke over a lead distance, fuel pressurization chamber 38 is connected to nozzle supply passage 26 primarily through restrictive passageway 39. After annular corner 42 clears annular shoulder 40, the main nozzle supply passage 34 opens as fuel begins to flow along flats 49 of plunger 48 into annulus 33.

Since restrictive passage 39 is of a relatively small diameter, only a portion of the fuel pressure created within fuel pressurization chamber 38 is transmitted to nozzle chamber 27 (FIG. 1) via nozzle supply passage 26. Nevertheless, restrictive passage 39 should be sufficiently large that the pressure transmitted to nozzle chamber 27 is above a valve opening pressure sufficient to overcome return spring 65. Thus, restrictive passage 39 should be sized to allow the pressure within nozzle chamber 27 to quickly rise above a valve opening pressure but sufficiently restrictive that pressure within nozzle chamber 27 does not exceed a pre-determined magnitude. After annular corner 42 clears annular shoulder 44 during the plunger's downward stroke, only a relatively small amount of fuel passes through restrictive passage 39, as main passage 34 is now open. During the initial portion of each injection event, since only a relatively small flow rate of fuel can flow through restrictive passage 39, the downward rate of plunger 48 is slowed relative to prior art plungers. The restrictive passage of the present invention allows the initial injection rate shape to be lowered without the need to spill excessive amounts of fuel. The innovation produced by the present invention was made possible at least in part because the main unrestricted nozzle supply passage 34 opens into plunger bore 35 above the end 46 of plunger 48, when it is in its retracted position.

Figure 5:
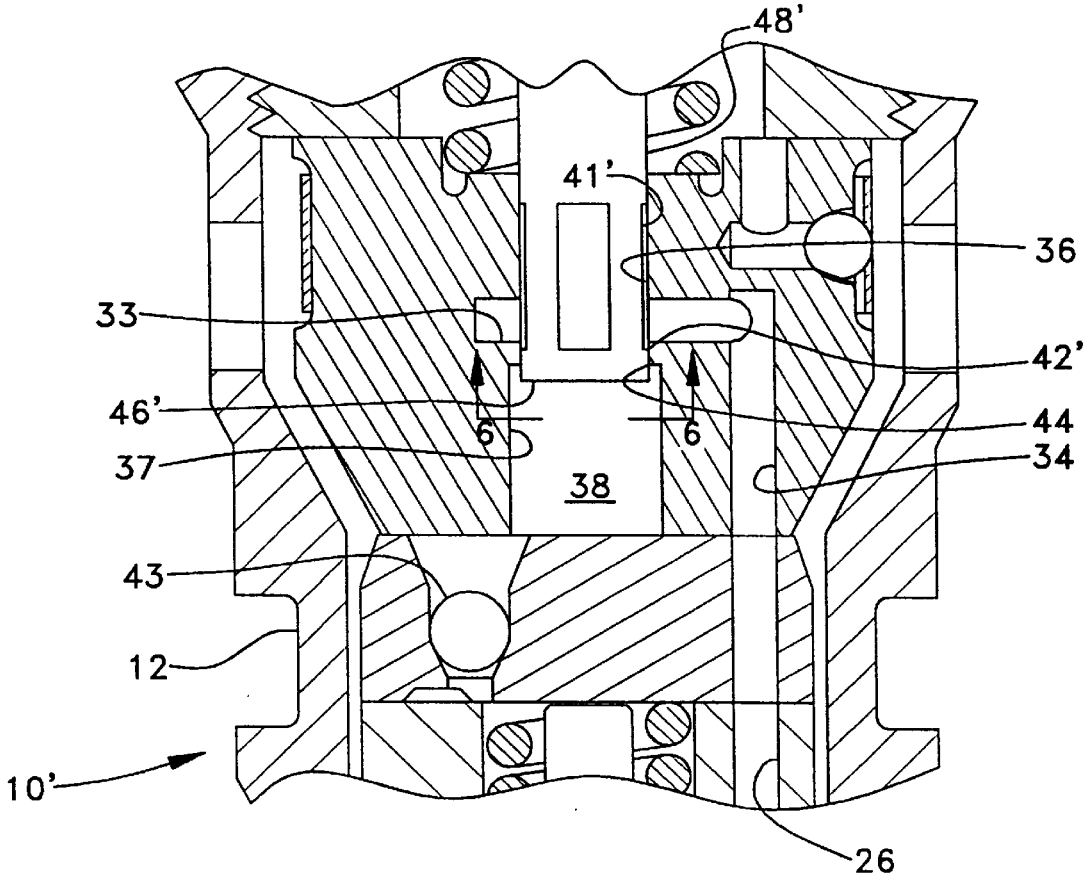
FIG. 5 is an enlarged partial sectioned side elevational view of a fuel pressurization chamber area of fuel injector according to another embodiment of the present invention.
Figure 6:
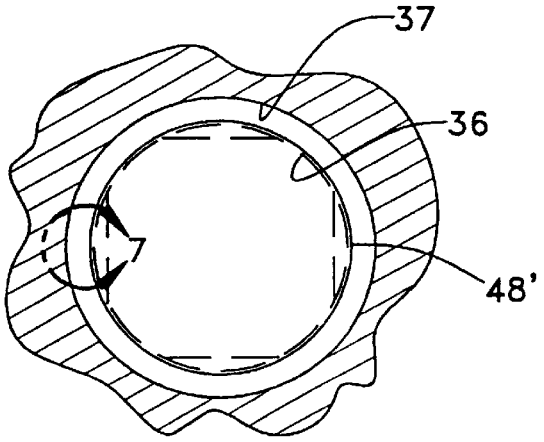
FIG. 6 is a partial sectioned bottom view along section lines 6—6 of FIG. 5.
Figure 7:
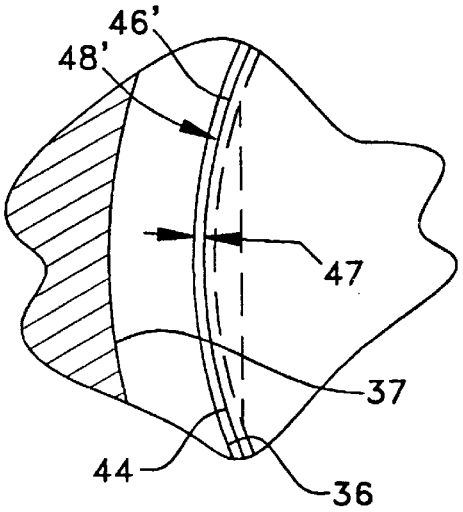
FIG. 7 is a greatly enlarged view of the circled portion in FIG. 6.

Referring now to FIG. 5, an enlarged portion of a fuel pressurization chamber 38 area of a fuel injector 10' according to another embodiment of the present invention is illustrated. The injector 10' of this embodiment is substantially similar in many respects to injector 10 described earlier. These similarities are indicated by the use of identical numbers to identify identical features. However, injector 10' is different from the previous injector 10 in that end portion 46' of plunger 48' includes a slightly reduced diameter that makes possible for the elimination of the restrictive passage 39 of the previous embodiment. In other words, in this embodiment, the clearance area 47 between plunger 48' and upper plunger bore 36 in the area of end portion 46' defines a restrictive flow area extending between annulus 33 and fuel pressurization chamber 38. Thus, instead of fuel flowing through a restrictive passage in the injector body, fuel flows along a restrictive passage defined by a portion of the injector body and a portion of plunger 48'. Although not perceptible in the drawings, end portion 46' is several microns smaller in diameter than the rest of plunger 48'.

In this embodiment, the restrictive passage defined by the clearance gap 47 only exists when plunger 48' is moving over its lead distance from its fully retracted position as shown until annular edge 42' clears annular shoulder 44 during the downward stroke. After this point, fuel flows freely from fuel pressurization chamber 38 along the flats in middle portion 41' of plunger 48', into annulus 33, on into main passage 34, through nozzle supply passage 26 and eventually into nozzle chamber 27 and out nozzle outlet 28. It is also important to note that in order to produce the regulated plunger motion of the present invention, it is often necessary that plunger bore 35 be stepped to include a larger diameter portion 37 that defines the bulk of fuel pressurization chamber 38 and a smaller diameter upper portion 36 within which plunger 48' defines a relatively tight clearance above the area of middle portion 41'. Thus, the upper bore portion 36 of plunger bore 35 acts as a guide for the circular areas between flats 49' of plunger 48'. The larger diameter lower area 37 allows the fuel to freely flow around the end 46' of plunger 48' during most of each injection event.

Figure 8:
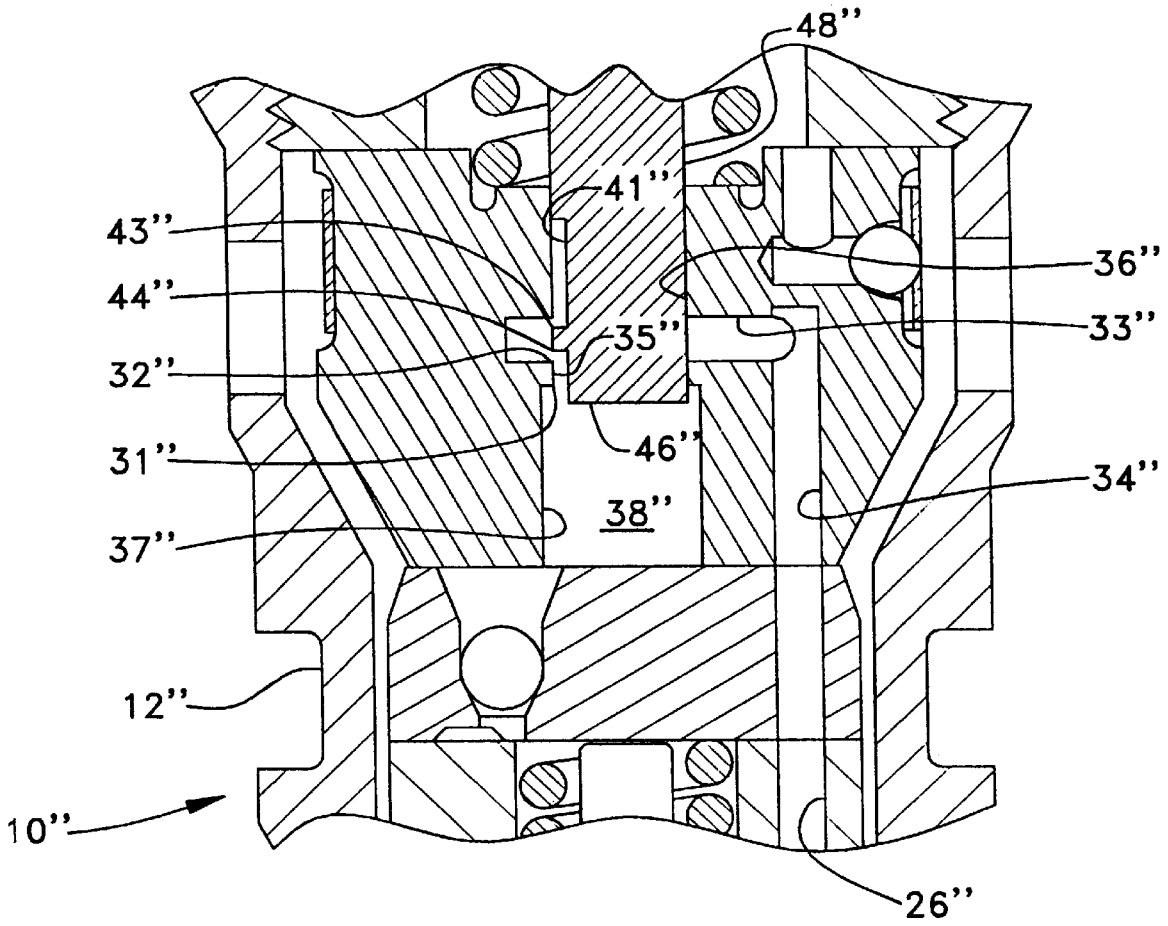
FIG. 8 is an enlarged partial sectioned side elevational view of a fuel pressurization chamber area of a fuel injector according to still another embodiment of the present invention.

Referring now to FIG. 8, still another embodiment of a fuel injector 10" according to the present invention is illustrated. This embodiment is similar to the previous embodiment 10' in that the flow restriction is defined by a clearance area between the outer surface of plunger 48" and plunger bore 35". However, unlike the previous embodiment, plunger 48" starts in a position in which the flow path between fuel pressurization chamber 38" and nozzle supply passage 26" is unrestricted over the initial downward stroke of the plunger. After this initial travel distance, the flow becomes restricted for another portion of the plunger's downward stroke, and then becomes again unrestricted for the main portion of injection. Thus, this embodiment of the present invention allows for the possibility of split injection.

When plunger 48" begins its downward stroke at the beginning portion of an injection event, flow from fuel pressurization chamber 38" is relatively unrestricted. This allows the needle valve (not shown) to open quickly after the plunger begins its downward stroke to allow the injection of fuel to commence. When corner 44" moves into a position adjacent annular shoulder 32", the flow from fuel pressurization chamber 38" becomes significantly restricted. The only fuel that passes does so around the clearance area between plunger 48" and a portion of plunger bore 35". This flow restriction can be designed to be so restrictive that a split injection occurs, or can be sized to sustain injection rate at a lower level while the flow restriction exists. The flow restriction ends when corner 43" clears lower annular shoulder 31". When this occurs, relatively unrestrictive flow resumes from fuel pressurization chamber 38" along middle portion 41" into annulus 33" and main nozzle supply passage 34". Thus, in this embodiment, injector body 12" is modified over the previous embodiments but the plunger 48" has flats as described previously. In this embodiment, only three flats are used.

Figure 9:
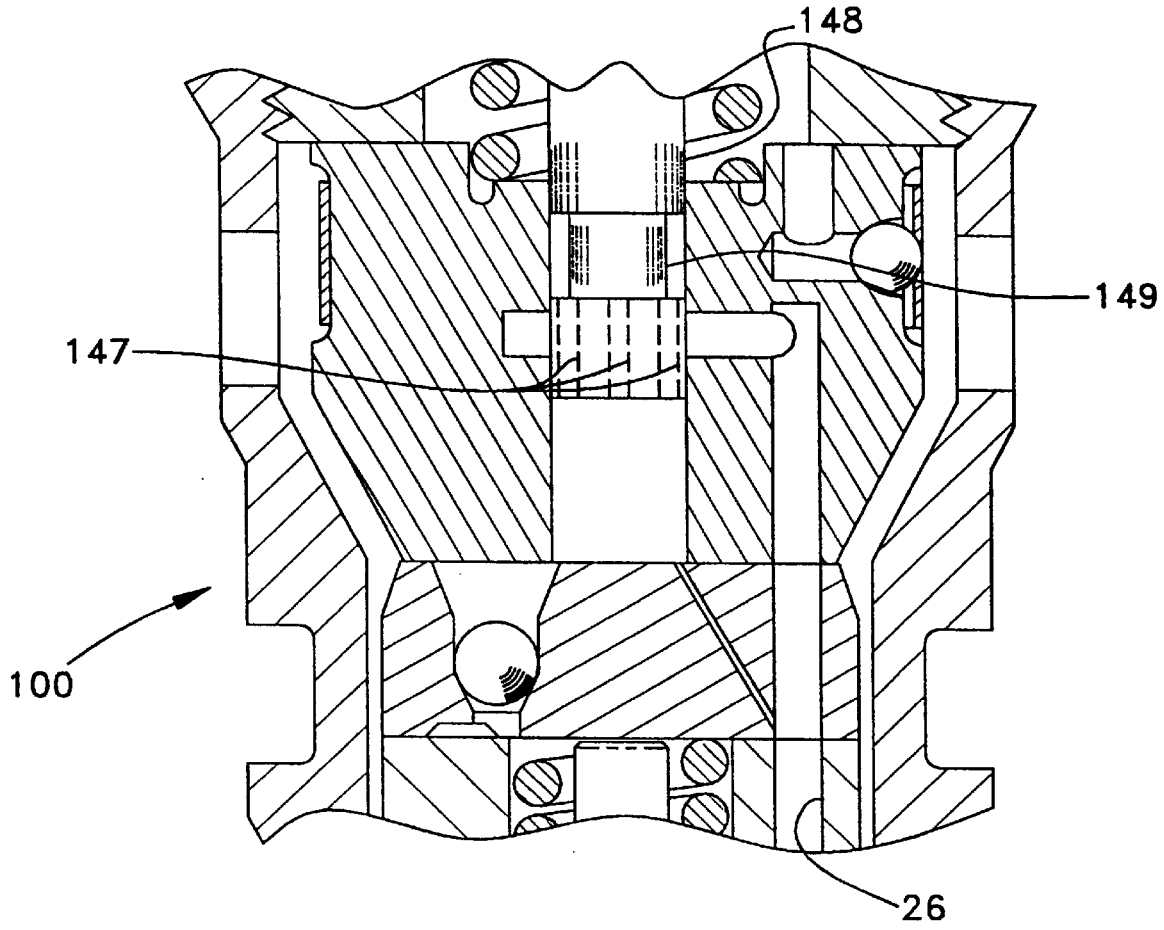
FIG. 9 is an enlarged partial sectioned side elevational view of a fuel pressurization chamber area of a fuel injector according to another embodiment of the present invention.

Referring now to FIG. 9, still another embodiment of the present invention is illustrated. In this case injector 110 is substantially identical to the injector shown in FIGS. 1 and 2, except that plunger 148 includes an annulus 149 instead of the flats 49 machined in plunger 48 of the earlier embodiment. This embodiment may be desirable if injectors according to the present invention are mass produced since circular features, such as annulus 149, are generally more easily machined to tight tolerances than non-circular features, such as flats 49 of the FIG. 2 embodiment. This is important in order to minimize the functional and performance variations between injectors due to machining tolerances. This embodiment may also be desirable in that it can utilize a plunger substantially identical to a plunger utilized in fuel injectors manufactured by Caterpillar, Inc. for several years. In particular, this embodiment can use the same plunger utilized in injectors manufactured under U.S. Pat. No. 5,492,098 for a Flexible Injection Rate Shaping Device For A Hydraulically-Actuated Fuel Injection System, and more commonly referred to as HEUI-prime. This embodiment is also advantageous because, instead of utilizing a stepped plunger bore as in the previous embodiments, this embodiment can use a plunger barrel having a uniform diameter plunger bore. This embodiment of the invention is different from the previous embodiments in that, as the plunger travels downward, the main passage to the nozzle chamber opens when annulus 149 and passage 147 open to the annulus formed in the plunger barrel.

Industrial Applicability

The present invention finds particular application in hydraulically actuated fuel injectors since there is no mechanical linkage requiring the plunger to be a certain stroke position at a certain time, as it generally would be in a cam driven fuel injector. Nevertheless, a cam driven injector could be modified by, for instance, introducing a spring between the plunger and tappet in order to incorporate the regulated plunger motion through restrictive flow according to the present invention.

Those skilled in the art will appreciate that the restrictive flow concepts behind the present invention could potentially be used to control injection mass flow rate by restricting fuel flow through the exploitation of plunger movement. In other words, the flow area allowed between fuel pressurization chamber 38 and nozzle chamber 27 could be restricted, and vary in magnitude, over a substantial portion of the initial downward stroke of the plunger. The innovation of the present invention in having the main passage 34 connecting plunger bore 35 to nozzle chamber 27 open above the end 46 of plunger 48 provides engineers with wide design latitude to control plunger motion by machining certain geometrical relationships between the plunger bore and the outer surface of the plunger. These geometrical relationships could either change or remain fixed, as illustrated above, as the plunger moves in its downward stroke.

The restricted flow rate shaping device of the present invention is designed to stretch the injection duration to reduce noise and roughness levels, especially at idle operating conditions, while having a minimal effect on the duration at rated operating conditions. By restricting fuel flow, rather than spilling fuel as in the prior art, the present invention decreases the oil necessary to actuate the complete fuel injection system. The restrictive flow area of the present invention, via a bore through the injector body or via a clearance distance between plunger and the plunger bore, controls the pressure rise rate around the needle valve. This can introduce a dwell period in the injection. Injection occurs when the restrictive flow area permits the pressure around the check to build above valve opening pressure. For a given valve opening pressure and valve closing pressure, the amount of fuel injected per pulse depends mainly on the volume around the needle valve and the area of the main unrestricted flow passage. The dwell period between any two consecutive injections depends primarily on the flow area of the restricted flow orifice. The dwell phenomenon can occur as long as the main path is the primary communication between the fuel pressurization chamber and the nozzle chamber. The dwell can be controlled by the lead distance, which is the distance the plunger has to travel before switching from the restrictive flow path to the main unrestricted flow passage. During rated operating conditions, the plunger stroke is more than the lead, which acts as a front end rate shaping device. Rate shaping occurs while the plunger is traveling the lead distance.

Those skilled in the art should appreciate that the above description is intended for illustrative purposes only, and is not intended to limit the scope of the present invention in any way. For instance, the above three examples are included only to show that the present invention can include a restrictive passage defined by the injector body or a restrictive passage defined at least in part by the plunger. The invention also contemplates a series of restrictive passages that open or close sequentially over the initial stroke of the plunger. Alternatively, the flow area of a restrictive passage can be made to vary during initial injection by engineering geometrical relationships between the plunger and the plunger bore. In any event, the intended scope of the present invention should be determined solely in terms of the claims as set forth below.

We claim:

1. A fuel injector comprising:

an injector body with a plunger bore, a nozzle chamber and a nozzle outlet that opens to said nozzle chamber;

a plunger positioned to reciprocate in said plunger bore between an advanced position and a retracted position;

a portion of said plunger and a portion of said plunger bore defining a fuel pressurization chamber;

at least one of said injector body and said plunger defining a main passage fluidly connecting said fuel pressurization chamber to said nozzle chamber;

at least one of said injector body and said plunger defining a restricted passage fluidly connecting said fuel pressurization chamber to said nozzle chamber;

said restricted passage being restrictive to flow relative to said main passage; and said main passage being substantially closed by said plunger over a first portion of said plunger's movement between said retracted position and said advanced position.

2. The fuel injector of claim 1 wherein said restricted passage has a first minimum flow area and said main passage has a second minimum flow area; and said second minimum flow area is many times larger than said first minimum flow area.

3. The fuel injector of claim 1 wherein said injector body defines said restricted passage.

4. The fuel injector of claim 1 wherein said main passage opens into said plunger bore above said fuel pressurization chamber.

5. The fuel injector of claim 4 wherein a portion of said restricted passage is defined by said plunger.

6. A fuel injector comprising:

an injector body with a plunger bore, a nozzle chamber and a nozzle outlet that opens to said nozzle chamber;

a plunger positioned to reciprocate in said plunger bore between an advanced position and a retracted position;

a portion of said plunger and a portion of said plunger bore defining a fuel pressurization chamber;

said injector body and said plunger defining at least one passage fluidly connecting said fuel pressurization chamber to said nozzle chamber; and said at least one passage having a restrictive flow area over a first portion of said plunger's movement between said retracted position and said advanced position, and having a relatively unrestricted flow area over a different portion of said plunger's movement between said retracted position and said advanced position.

7. The fuel injector of claim 6 wherein said different portion is the remaining portion of said plunger's movement from said retracted position to said advanced position.

8. The fuel injector of claim 7 wherein said at least one passage includes a restricted passage and a main passage.

9. The fuel injector of claim 8 wherein said main passage is substantially closed over said first portion of said plunger's movement between said retracted position and said advanced position.

10. The fuel injector of claim 6 wherein said at least one passage is a single passage; and said restricted flow area includes a clearance area between said plunger and said plunger bore.

11. The fuel injector of claim 10 wherein said restrictive flow area is many times smaller than said relatively unrestricted flow area.

12. The fuel injector of claim 6 wherein said first portion of said plunger's movement begins at said retracted position; and said different portion is a majority of said plunger's movement between said retracted position and said advanced position.

13. A hydraulically actuated fuel injector comprising:

an injector body having an actuation fluid inlet, and actuation fluid drain and a piston bore, and having a plunger bore that opens to a fuel supply passage, and a nozzle chamber that opens to and a nozzle outlet;

a control valve member mounted in said injector body and being moveable between a first position that opens said actuation fluid inlet and closes said actuation fluid drain, and a second position that closes said actuation fluid inlet and opens said actuation fluid drain;

an intensifier piston positioned to reciprocate in said piston bore between an upper position and a lower position;

a plunger positioned to reciprocate in said plunger bore between a retracted position and an advanced position;

a portion of said plunger bore and said plunger defining a fuel pressurization chamber fluidly connected to said nozzle chamber;

a needle check positioned to reciprocate in said nozzle chamber between a closed position that closes said nozzle outlet and an open position that opens said nozzle outlet;

said injector body and said plunger defining at least one nozzle supply passage that fluidly connect said fuel pressurization chamber to said nozzle chamber; and said at least one nozzle supply passage having a restrictive flow area over a first portion of said plunger's movement between said retracted position and said advanced position, and having a relatively unrestrictive flow area over a different portion of said plunger's movement between said retracted position and said advanced position.

14. The fuel injector of claim 13 wherein said at least one nozzle supply passage includes a restricted passage and a main passage.

15. The fuel injector of claim 14 wherein said main passage is substantially closed over said first portion of said plunger's movement between said retracted position and said advanced position.

16. The fuel injector of claim 14 wherein said restricted passage has a first flow area and said main passage has a second flow area; and said second flow area is many times larger than said first flow area.

17. The fuel injector of claim 13 wherein said at least one nozzle supply passage is a single passage; and said restricted flow area includes a clearance area between said plunger and said plunger bore.

18. The fuel injector of claim 13 wherein one of said at least one nozzle supply passage opens into said plunger bore above said fuel pressurization chamber.

19. The fuel injector of claim 13 wherein said at least one nozzle supply passage is defined at least in part by an annulus formed on said plunger.

20. The fuel injector of claim 13 wherein said portion of said plunger's movement begins said retracted position; and said different portion is a majority of said plunger's movement between said retracted position and said advanced position.

* * * * *